US006070542A

United States Patent [19]

Wong

[11] Patent Number: 6,070,542

[45] Date of Patent: Jun. 6, 2000

[54] PUCKER FREE COLLAR SEAM AND METHOD OF MANUFACTURE

[75] Inventor: John Wong, Montreal, Canada

[73] Assignee: Taltech Limited, Tortola, Virgin Islands (Br.)

[21] Appl. No.: 09/239,955

[22] Filed: Jan. 29, 1999

Related U.S. Application Data

[63] Continuation-in-part of application No. 08/613,656, Mar. 11, 1996, Pat. No. 5,590,615, which is a continuation of application No. 08/245,122, May 17, 1994, Pat. No. 5,568,779, and a continuation-in-part of application No. 08/782,005, Jan. 6, 1997, Pat. No. 5,782,191, and a continuation-in-part of application No. 08/782,003, Jan. 6, 1997, Pat. No. 5,775,394, and a continuation-in-part of application No. 08/779,096, Jan. 6, 1997, Pat. No. 5,713,292, and a continuation-in-part of application No. 08/782,004, Jan. 6, 1997, Pat. No. 5,950,554, and a continuation-in-part of application No. 08/782,002, Jan. 6, 1997.

[51] Int. Cl.[7] ..... D05B 1/18; A41D 27/18

[52] U.S. Cl. ..... 112/475.09; 112/441

[58] Field of Search ..... 112/441, 475.08, 112/426, 423; 2/275, 247, 115, 122, 125, 248; 156/93

[56] References Cited

U.S. PATENT DOCUMENTS

| | | | |
|---|---|---|---|
| 1,706,461 | 3/1929 | Oathout . | |
| 1,784,942 | 12/1930 | Miller . | |
| 1,862,377 | 6/1932 | Harper | 112/475.09 |
| 2,120,458 | 6/1938 | Bodle . | |
| 2,240,902 | 5/1941 | Fishman . | |
| 2,264,224 | 11/1941 | Swan . | |
| 2,266,953 | 12/1941 | Blue . | |
| 2,719,803 | 10/1955 | Nottebohm . | |
| 2,731,788 | 1/1956 | Donaldson, Jr. . | |
| 2,855,606 | 10/1958 | Berg . | |
| 2,925,642 | 2/1960 | Pfeffer, Jr. . | |
| 2,937,380 | 5/1960 | Reese . | |
| 2,988,457 | 6/1961 | Gatcomb . | |
| 3,094,705 | 6/1963 | Reid et al. . | |
| 3,333,280 | 8/1967 | Hynek et al. | 112/475.09 |
| 3,399,642 | 9/1968 | Etchison et al. . | |
| 3,453,662 | 7/1969 | Weiss . | |
| 3,629,866 | 12/1971 | Blue | 2/122 |
| 4,077,066 | 3/1978 | Weiss . | |
| 4,549,916 | 10/1985 | Off et al. . | |
| 4,561,128 | 12/1985 | Zimmerman . | |
| 4,803,109 | 2/1989 | Saniscalchi . | |
| 5,003,902 | 4/1991 | Benstock et al. . | |
| 5,063,101 | 11/1991 | Grynaeus et al. . | |
| 5,568,779 | 10/1996 | Wong . | |
| 5,590,615 | 1/1997 | Wong . | |

FOREIGN PATENT DOCUMENTS

| | | |
|---|---|---|
| 0791674 | 8/1997 | European Pat. Off. . |
| 1104802 | 12/1958 | Germany . |
| 08209419 | 8/1996 | Japan . |
| 641576 | 8/1950 | United Kingdom . |
| 2030844 | 4/1980 | United Kingdom . |

*Primary Examiner*—Ismael Izaguirre
*Attorney, Agent, or Firm*—Kile McIntyre Harbin & Lee; Bradford E. Kile

[57] ABSTRACT

A pucker free collar seam providing a garment with a tailored and wrinkle free appearance. The pucker free seam and method for production utilizes a bonding strip, which contains at least a thermal adhesive component which is inserted between a first surface of a first collar component and an interlining along a seam. A sufficient amount of heat and pressure is applied to the seam, causing the adhesive of the bonding strip to flow onto the surfaces of the collar components and the interlining, thereby creating a compressed seam and permanently bonding a first collar component, a second collar component and an interlining together along the seam to eliminate puckering associated with the shrinkage of sewing thread relative to the collar fabric.

39 Claims, 2 Drawing Sheets

PUCKER FREE COLLAR SEAM AND METHOD OF MANUFACTURE

RELATED INVENTION

This application is a continuation-in-part of applicant's prior application Ser. No. 08/613,656 filed Mar. 11, 1996, entitled "Pucker Free Garment Seam and Method of Manufacture" now U.S. Pat. No. 5,590,615 which is a continuation of applicant's prior application. Ser. No. 08/245,122, filed May 17, 1994 entitled "Pucker Free Garment Seam and Method of Manufacture" now U.S. Pat. No. 5,568,779, as well as applicant's previously filed continuation-in-part applications Ser. No. 08/782,005, filed Jan. 6, 1997, entitled "Pucker Free Right Front Hem Garment Seam and Method for Manufacture" now U.S. Pat. No. 5,782,191, Ser. No. 08/782,003, filed Jan. 6, 1997, entitled "Pucker Free Sleeve Placket Garment Seam and Method for Production" now U.S. Pat. No. 5,775,394, Ser. No. 08/779,096, filed Jan. 6, 1997, entitled "Pucker Free Pocket Garment Seam and Method for Production" now U.S. Pat. No. 5,713,292 and applicant's continuation-in-part applications, Ser. No. 08/782,004, filed Jan. 6, 1997, entitled "Pucker Free Yoke-to-Front and Yoke-to-Back Garment Seam and Method for Manufacture" now U.S. Pat. No. 5,950,554 and Ser. No. 08/782,002, filed Jan. 6, 1997, entitled "Pucker Free Garment Side Seam and Method for Production", which are similarly entitled to the benefit of the filing date of the first application. All patents and applications are of identical inventorship and of common assignment herewith.

BACKGROUND OF THE INVENTION

The present invention relates to a pucker free garment seam and method of manufacture. More specifically, the invention is directed to an improved garment seam and method of manufacture which facilely eliminates a tendency of the seam to bunch or pucker along a free edge of a shirt collar and other similar areas following conventional laundering procedures.

The clothing industry has long suffered from a puckering phenomenon that occurs at seam lines on garments. Seam pucker occurs during laundering and is typically caused by thread shrinkage that results from exposure to ordinary laundering cycles. Thread shrinkage proceeds at a rate greater than surrounding shirt material which creates relative movement and a waviness or puckering at a seam joining two panels of fabric. More specifically, during a typical washing and drying operation, the sewing thread contracts and pulls on opposing collar components at the garment seam. This thread shrinkage causes the next adjacent garment material to contract and buckle and thereby creates waves along the garment seam. This effect is distinctly noticeable in a dress shirt collar seam which is essentially exposed at the eye level of a viewer. Moreover, a shirt collar seam is unique in that it has a free edge and thus no adjacent panel stability. Accordingly, it would be very desirable to provide a shirt collar and method of manufacture which would maintain a free edge seam of a collar which is smooth and pucker free even after multiple laundering operations.

Several techniques have been suggested in order to reduce seam pucker within a collar. One common procedure is to starch the collar. Starching a shirt with each laundering creates a flat neat appearance, however, starching with every laundering has distinct disadvantages. A starched shirt collar is harsh around the neck of a wearer. Well starched and smooth shirts require a professional laundry treatment, which is somewhat expensive and inconvenient. Moreover, it is believed that each repeated starching tends to shrink a shirt collar.

Another process uses an interlining having a thermoplastic component in the interlining matrix. During the manufacture process, the seam is ironed such that the cross-sectional thickness of the seam is reduced along the stitch line. This reduced thickness allows for slack in the sewing thread. This permits the sewing thread to shrink an amount equal to the slack during subsequent launderings. This technique, however, is not entirely effective in reducing seam pucker. First, the collar components sewn together at the seam are allowed to pull apart between outer stitches of the seam, resulting in buckling of the garment fabric. Second, the thread binds with the matrix of the interlining when it is compressed; therefore, the shrinkage of the thread still results in at least a degree of seam pucker.

Another attempt in the prior art to minimize seam pucker utilizes specified garment material—material that stretches during the sewing process and relaxes after the sewing process is complete. This relaxation allows for slack in the sewing thread. However, this attempt is also ineffective in reducing seam pucker. First, as before, the collar components that are sewn together at the seam are permitted to pull apart between outer stitches of the seam which results in buckling of the garment fabric. Second, only garments manufactured from certain stretch materials may be utilized to produce the garments. The disadvantages associated with this technique are clear.

Another method envisioned to solve the problem of seam pucker entailed altering the nature of the sewing thread rather than focusing on the fabric components. One such attempt uses a composite sewing thread whereby one component of the thread is water soluble. During the laundering process, the water soluble component dissolves and creates slack in the sewing thread which compensates for thread shrinkage. Yet, this attempt also exhibits limitations in minimizing seam pucker. First, as before, the collar components sewn together at the seam are allowed to pull apart between outer stitches of the seam, resulting in bucking of the garment fabric. Second, the high cost of manufacturing a sewing thread altered in such a manner greatly increases the overall garment cost. Third, commercial sewing apparatus are not well suited to utilize altered thread. Last, thread strength is greatly reduced by such a composite design. Other prior art attempts that alter the nature of the sewing thread are ineffective for the same noted reasons.

Still another prior art attempt to eliminate seam pucker incorporates an interlining coated with an adhesive between outer and inner fabric panels. In this assembly, an initial set stitch traverses the interlining causing it to maintain a stationary position. Further, the set stitch traversing the interlining causes the interlining to be folded over in the formation of the seam creating undesirable thickness to a finished, free edge of a shirt collar.

The difficulties and limitations suggested in the preceding are not intended to be exhaustive, but rather are among many which demonstrate that although significant attention and energy have been devoted to reducing and minimizing pucker in garment seams for decades, the puckerless garment seams and method of manufacture appearing in the past will admit to worthwhile improvement.

OBJECTS AND BRIEF SUMMARY OF THE INVENTION

It is therefore a general object of the invention to provide a novel, smooth garment seam and method of manufacture which will obviate or minimize the difficulties of the type previously described.

It is a specific object of the invention to provide a smooth garment seam and method of manufacture that will eliminate seam pucker at a free edge of a dress shirt collar seam.

It is another object of the invention to provide a smooth garment seam and method of manufacture which may be used for a free edge of a variety of garments to provide a pucker free tailored appearance.

It is still another object of the invention to provide a smooth garment seam and method of manufacture for advantageous use in a free edge seam of a dress shirt.

It is yet another object of the invention to provide a smooth garment seam and method of manufacture for advantageous use in a free edge of a collar seam of a dress shirt.

It is still yet another object of the invention to provide a smooth garment seam and method of manufacture that provides for a cost effective solution to free edge seam pucker and does not involve significant modification of existing manufacturing apparatus.

BRIEF SUMMARY OF A PREFERRED EMBODIMENT OF THE INVENTION

A preferred embodiment of the invention that is intended to accomplish the foregoing objects includes a bonding element which contains at least a thermal adhesive component that is placed on top of a first collar component. This combination is positioned above a second collar component. An interlining element is bonded to a portion of the first component. A set stitch is sewn through the thermal adhesive component, the first collar component and the second collar component. The first and second collar components are reverse folded along a seam line of the garment. A top stitch is then placed along the free edge and extends through the first collar component, the interlining, the thermal adhesive component, again through the first collar component and two layers of the second collar component. The seam is then subjected to a sufficient amount of heat and pressure to cause the adhesive of the bonding element to flow over the surfaces of the collar components and top stitch thereby creating a compressed seam and permanently bonding the first and second collar components, interlining and top stitch together along the seam to eliminate puckering associated with sewing thread shrinkage.

DRAWINGS

Other objects and advantages of the present invention will become apparent from the following detailed description of a preferred embodiment thereof taken in conjunction with the accompanying drawings, wherein.

Figure 3:
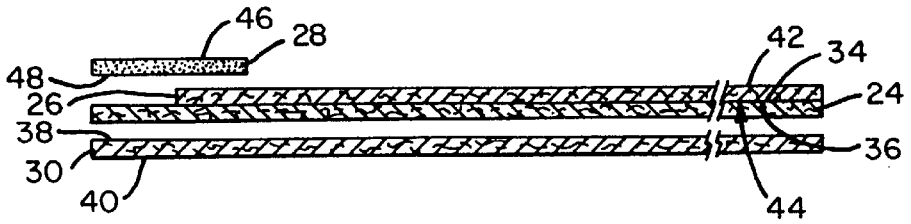
Figure 4:
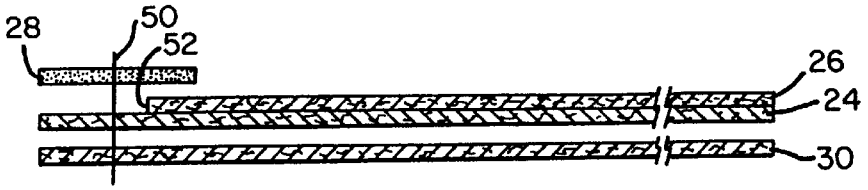
Figure 5:
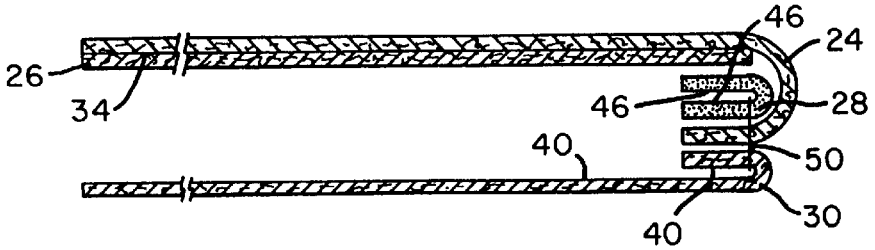
Figure 6:
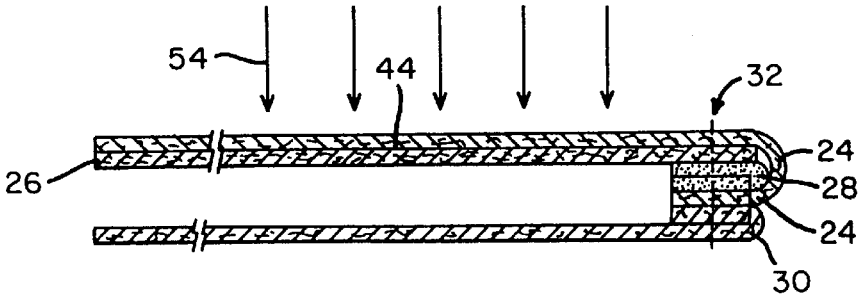

FIGS. 3 through 5 disclose cross-sectional views of a method of manufacturing a dress shirt free edge seam, such as a collar seam, in accordance with the present invention; and FIG. 6 discloses a cross-sectional view of a completed free edge, collar seam 14 produced in accordance with the present invention.

DETAILED DESCRIPTION

Context of the Invention

Figure 1:
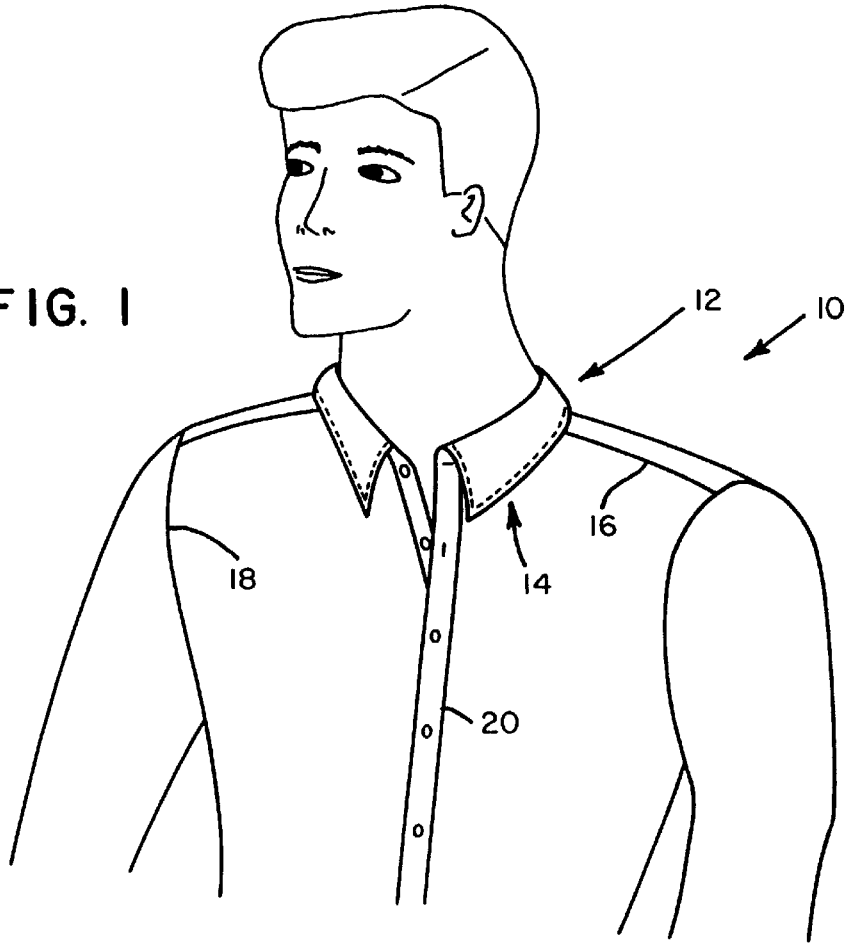
FIG. 1 is a pictorial view showing a human male figure wearing a shirt having a free edge, collar seam manufactured in accordance with the present invention.

Referring now to the drawings and particularly to FIG. 1, there is shown a dress shirt 10. The shirt 10 includes a collar 12, having an free edge, and a collar seam 14, produced in accordance with the present invention. The shirt includes a yoke-to-front seam 16, a shoulder seam 18, a front placket seam 20, and other shirt seams as more fully disclosed in applicant's above-referenced related applications and patents, the disclosures of which are hereby incorporated by reference as though set forth at length.

Free Edge Collar Seam

Figure 2:
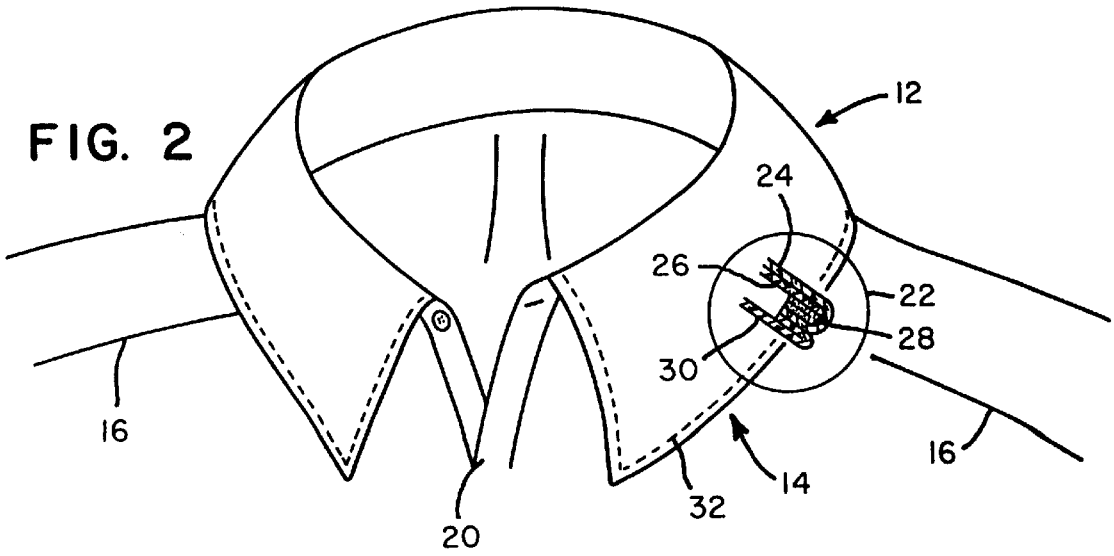
FIG. 2 is a schematic detail view showing a collar seam of the dress shirt depicted in FIG. 1 where a free edge of the collar seam is cut to expose a cross-sectional view and magnified to disclose structural seam details in accordance with the present invention.

The subject invention is directed to a free edge, collar seam 14. FIG. 2 depicts a segment of the free edge, collar seam 14 of a dress shirt. The phenomenon of seam pucker is particularly troubling in a free edge, seam because of its location which is generally on the eye level of a person viewing the shirt 10. As depicted within the expanded zone 22, the subject collar seam includes a first collar component 24, an interlining 26, a thermal strip 28, which is reverse folded upon itself, and a second collar component 30. A top stitch 32 extends through the first collar component 24, the interlining 26, the reverse folded thermal strip 28, again through the first collar component 24 and then through a folded over portion of the second collar component 30. Once the top stitch 32 is made, the free edge seam is subjected to heat and pressure 54, as will be discussed below, to bind the seam components and to stitch together as a fused and pucker free unit, essentially for the life of the shirt.

Method of Production

FIGS. 3 through 5 depict the sequence of steps for producing the free edge, collar seam 14 of the present invention. FIG. 6 shows a cross-sectional view of a completed free edge, collar seam 14 produced in accordance with the present invention.

Referring now to FIG. 3, there is shown a first collar component 24 and a second collar component 30. In the free edge, collar seam embodiment of the present invention, the first collar component comprises the top collar fabric of a dress shirt and the second collar component comprises the bottom collar fabric of a dress shirt. The first collar component 24 has a first surface 34 and a second surface 36. The second collar component 30 has a first surface 38 and a second surface 40. Additionally, there is shown an interlining 26. The interlining 26 has a first surface 42 and a second surface 44.

A thermal bonding strip 28 forms an integral part of the present invention. The bonding strip 28 has a first surface 46 and a second surface 48. In a preferred embodiment of the invention, as shown in the Figures, the bonding strip 28 is an adhesive web consisting entirely of an adhesive material. The adhesive material is preferably composed of a polyamide, polyester, or an olefinic material such as a low density polyethylene. Other thermoplastic materials such as polyurethane and ethylene vinylacetate copolymer can also be used. The aforementioned adhesives are preferable because they all have a low melting point, in the range of 60–160 degrees Celsius. In the preferred embodiment, the adhesive web is produced from a plurality of filaments having a diameter ranging between 20–80 microns. Furthermore, the adhesive web of the present invention has a density of approximately 10–100 grams per square meter. Alternatively, a more solid structured net adhesive may be used having a density preferably in the range of 8– 80 grams per square meter. Of course, other types of adhesives are contemplated in the present invention.

The interlining 26 is bonded to the first surface 34 of the first collar component 24 and extends towards, but stops short of, the edge of the first collar component. In FIG. 4, a set stitch 50 is sewn along the seam line defined by the edges of the elements of the seam and through the bonding strip 28, beyond an edge of the interlining 52, through the first collar component 24 and the second collar component 30. Since the interlining 26 is recessed, the set stitch does not pass through the interlining.

In FIG. 5, the bonding strip 28 is reverse folded, around the stitch 50, from its edge so that the reverse folded first surface of the bonding strip 46 runs generally coextensively with the unfolded first surface of the bonding strip 46. The first collar component 24 is reverse folded, at the set stitch 50, the reverse folded bonding strip 28, and the interlining 26, from its edge so that the reverse folded first surface of the first collar component 34 abuts the second surface of the interlining 44. Also, the second collar component 30 is reverse folded, at the set stitch 50, from its edge so that the reverse folded second surface of the second collar component 40 abuts the second surface of the second collar component 40.

In FIG. 6, a top stitch 32 is shown sewn along the seam defined by the reverse folded portion of the first collar component 24, the interlining 26, the reverse folded portion of the bonding strip 28, the bonding strip 28, the first collar component 24, the second collar component 30, and the reverse folded portion of the second collar component 30. As depicted in FIG. 6, this top stitch 32 traverses the reverse folded portion of the first collar component 24, the interlining 26, the reverse folded portion of the bonding strip 28, the unfolded portion of the bonding strip 28, the unfolded portion of the first collar component 24, the second collar component 30, and the reverse folded portion of the second collar component 30. In the embodiment in FIGS. 3 through 6, the top stitch is a single needle stitch. In certain instances, a double stitch can be used to enhance the strength and/or appearance of the seam.

Production of the improved seam 14 of the present invention is completed with the application of heat and pressure to the seam schematically illustrated by directional arrows 54 in FIG. 6. This can be accomplished with an ironing process. For improved control and quality, this process is usually carried out on a heated press, the result of which is depicted in FIG. 6, with a temperature of up to 160 degrees Celsius for 5 to 10 seconds followed with a vacuum step to cool and set the adhesive. The applied heat and pressure 54 cause the adhesive of the bonding strip 28 to melt and flow onto the first surface of the first collar component 34 and concomitantly onto the first surface of the interlining 42. Significantly, during the ironing/pressing process 54, the flowing adhesive becomes interposed in the interstices of the collar fabric of the first collar component 24, the interlining 26, and the top stitch 32. This is advantageous because it creates a strong bond between the first collar component 24 and the stitch along the free edge, collar seam 14. It is this bond that prevents seam pucker during subsequent laundering operations. In particular, because the first collar component 24 is bonded to the interlining 26 and the thread of the stitch along the seam 14, it does not pull apart during laundering and, therefore, buckling or puckering of the seam fabric will be prevented. This is a significant advantage over the prior art seams which permit the fabric layers to become separated during subsequent laundering operations which, in turn, results in seam pucker. The ironing/pressing process 54 also compresses the seam 14 to seam thickness.

The present invention incorporates an interlining. Interlinings are known in the prior art for providing stiffness in collar components, however, it is heretofore unknown to employ an interlining in the position and manner described herein. The interlining is preferably a woven interlining made from cotton or a cotton/polyester blend. Alternatively, a nonwoven interlining body made from polyester, nylon, viscose or blends of these materials may be used. Moreover, in an alternative embodiment, a thermal adhesive component may be applied to the first surface of the interlining, the second surface of the interlining, or both surfaces of the interlining. Preferably, the interlining body is fabricated from a single material so as to avoid the high cost associated with producing composite interlinings.

SUMMARY OF MAJOR ADVANTAGES OF THE INVENTION

After reading and understanding the foregoing detailed description of an inventive free edge, collar seam and method of manufacture in accordance with the preferred embodiment of the invention, it will be appreciated that several advantages of the subject garment seam and method of manufacture are obtained.

Without attempting to set forth all of the desirable features of the instant collar seam and method of manufacture, at least some of the major advantages include providing a pucker free garment seam consisting of a first collar component, a second collar component, an interlining and a thermal bonding strip.

The use of a bonding strip provides a pucker free garment seam which has not been accomplished by the attempts in the prior art. Preferably, the bonding strip comprises an adhesive web which flows during ironing into the abutting surfaces of the first collar component and the interlining to create a strong bond along the free edge, collar garment seam. This bond prevents the first collar component and the stitch from separating and relative movement during subsequent laundering of the garment. The interlining can be fabricated from a single material, thus avoiding the use of costly composite interlinings.

The free edge, collar garment seam and method of manufacture of the present invention provide a less costly alternative to other prior art attempts at eliminating seam pucker and eliminate any need for any substantial modification to the current seam production operations.

In describing the invention, reference has been made to a preferred embodiment and illustrative advantages of the invention. Those skilled in the art, however, and familiar with the instant disclosure of the subject invention, may recognize additions, deletions, modifications, substitutions and other changes which fall within the purview of the subject invention.

What is claimed is:

1. A method of manufacturing a pucker free seam at a junction of a first and a second shirt collar component comprising the steps:

(a) providing a first collar component, having a first surface and a second surface;

(b) providing a second collar component, having a first surface and a second surface extending generally coextensively with said first collar component and where the second surface of the first collar component contacts the first surface of the second collar component at an edge seam;

(c) providing an interlining, having a first and a second surface and at least one edge, in an adjacent relationship with the first surface of the first collar component;

(d) placing a bonding strip along the edge seam and said bonding strip having a first surface and a second surface and having a thermal adhesive component, said bonding strip being placed along the edge seam such that the second surface of the bonding element abuts the first surface of the first collar component;

(e) sewing the first and second collar components and the bonding element together by a set stitch that extends through the bonding strip, beyond an edge of the interlining, through the first collar component, and through the second collar component;

(f) reverse folding the second collar component beneath the set stitch such that the second surface of the second collar component folds onto itself at an edge seam;

(g) reverse folding the first collar component and the bonding element about the set stitch such that the bonding element folds back upon itself and the first surface of said first collar component folds around said bonding strip at an edge seam and abuts the second surface of the interlining;

(h) sewing said first and second collar components, said bonding element, and said interlining together by a top stitch running along said seam and extending through the reverse folded first collar component, the interlining, the reverse folded bonding strip, the unfolded bonding strip, the unfolded first collar component, the unfolded second collar component, and the reverse folded second collar component; and (i) applying sufficient heat and pressure to said bonding element to cause said thermal adhesive to melt such that said adhesive flows onto said surfaces of at least the first collar component, said interlining and said top stitch to provide a bond along the edge seam such that the bonded component will effectively reduce a tendency of the seam to pucker during laundering operations.

2. The method of manufacturing a pucker free seam at a junction of a first and a second shirt collar component as defined in claim 1, wherein:

said adhesive is composed of thermoplastic material.

3. The method of manufacturing a pucker free seam at a junction of a first and a second shirt collar component as defined in claim 1, wherein:

said adhesive is composed of a thermoplastic material selected from the group consisting of polyamide, polyester, olefinic, polyurethane, and ethylene vinylacetate copolymer materials.

4. The method of manufacturing a pucker free seam at a junction of a first and a second shirt collar component as defined in claim 1, wherein:

said thermal adhesive has a melting point ranging from approximately 60 to 160 degrees Celsius.

5. The method of manufacturing a pucker free seam at a junction of a first and a second shirt collar component as defined in claim 1, wherein:

said bonding strip is a thermal adhesive net having a density of approximately 8 to 80 grams per square meter.

6. The method of manufacturing a pucker free seam at a junction of a first and a second shirt collar component as defined in claim 1, wherein:

the application of heat and pressure of step (i) is accomplished by ironing and pressing.

7. The method of manufacturing a pucker free seam at a junction of a first and a second shirt collar component as defined in claim 6, wherein:

said ironing and pressing is carried out at a temperature up to 160 degrees Celsius for five to ten seconds.

8. The method of manufacturing a pucker free seam at a junction of a first and a second shirt collar component as defined in claim 1, wherein:

said application of heat and pressure step (i) is followed by a step of applying a vacuum to cool and set the adhesive.

9. The method of manufacturing a pucker free seam at a junction of a first and a second shirt collar component as defined in claim 1, wherein:

said bonding strip is a thermal adhesive web or net composed entirely of a thermal adhesive.

10. The method of manufacturing a pucker free seam at a junction of a first and a second shirt collar component as defined in claim 9, wherein:

said thermal adhesive web is composed of a plurality of adhesive filaments having a diameter ranging approximately between 20 to 80 microns.

11. The method of manufacturing a pucker free seam at a junction of a first and a second shirt collar component as defined in claim 9, wherein:

said thermal adhesive web has a density of approximately 10 to 100 grams per square meter.

12. The method of manufacturing a pucker free seam at a junction of a first and a second shirt collar component as defined in claim 1, wherein:

said interlining has a quantity of thermal adhesive at least on the second surface of the interlining.

13. The method of manufacturing a pucker free seam at a junction of a first and a second shirt collar component as defined in claim 12, wherein:

said interlining is a woven interlining fabricated from cotton.

14. The method of manufacturing a pucker free seam at a junction of a first and a second shirt collar component as defined in claim 12, wherein:

said interlining is a woven interlining fabricated from polyester/cotton blend.

15. The method of manufacturing a pucker free seam at a junction of a first and a second shirt collar component as deemed in claim 12, wherein:

said interlining is a nonwoven interlining fabricated from a material selected from the group consisting of polyester, nylon, and viscose and blends thereof.

16. The method of manufacturing a pucker free seam at a junction of a first and a second shirt collar component as defined in claim 12, wherein:

said interlining is bonded to the first collar component prior to the manufacture of the garment.

17. The method of manufacturing a pucker free seam at a junction of a first and a second shirt collar component as deemed in claim 1, wherein:

said bonding strip comprises an interlining having on first and second surfaces a quantity of thermal adhesive.

18. The method of manufacturing a pucker free seam at a junction of a first and a second shirt collar component as defined in claim 17, wherein:

said interlining is a woven interlining fabricated from cotton.

19. The method of manufacturing a pucker free seam at a junction of a first and a second shirt collar component as defined in claim 17, wherein:

said interlining is a woven interlining fabricated from polyester/cotton blend.

20. The method of manufacturing a pucker free seam at a junction of a first and a second shirt collar component as defined in claim 17, wherein:

said interlining is a nonwoven interlining fabricated from a material selected from the group consisting of polyester, nylon, and viscose and blends thereof.

21. The method of manufacturing a pucker free seam at a junction of a first and a second shirt collar component as defined in claim 1, wherein:

step (i) further comprises said heat and pressure being applied for at least five seconds.

22. A smooth, edge seam in a shirt collar comprising:

(a) a bonding strip having at least a thermal adhesive component and having a first and a second surface, the bonding strip being folded such that a portion of the first surface of the bonding strip is bonded with the remaining portion of said first surface such that an edge seam is created;

(b) an interlining having a first and a second surface, the second surface of the interlining is bonded to a reverse folded portion of a first surface of a first collar component, and a portion of the first surface of the interlining, extending from the outer edge of the seam inward, is bonded to a portion of the second surface of the reverse folded bonding strip;

(c) a first collar component having a first and a second surface folded such that a portion of said second surface of the first collar component abuts a first surface of said second collar component and that a portion of the first surface of the first collar component is bonded to the bonding strip along the seam and the reverse folded portion of the first collar component is bonded to the second surface of the interlining adjacent to said bonding strip along the seam;

(d) a second collar component having a first and a second surface, the second collar component being reverse folded away from the bonding strip and the interlining such that a portion of the second surface of the second collar component is adjacent to, and in contact with, a length of the remaining portion of the second surface of the second collar component;

(e) a set stitch running along the edge of the seam and traversing through the bonding element, beyond said interlining, through said first collar component adjacent to the interlining, and through said second collar component which abuts said second surface of the first collar component;

(f) a top stitch running along the seam and traversing through the reverse folded first collar component, the interlining, the reverse folded bonding strip, the unfolded bonding strip, the unfolded first collar component, the unfolded second collar component, and the reverse folded second collar component; and (g) said bonding strip, having been subjected to a sufficient amount of heat and pressure to cause the thermal adhesive to bond to the first surface of the first collar component, the first surface of the interlining, and a portion of the first surface of the bonding strip itself, such that a bond is formed by the bonding strip along the seam to reduce a tendency of the seam to pucker following laundering.

23. The smooth, edge seam in a shirt collar as defined in claim 22, wherein:

said adhesive is composed of a thermoplastic material.

24. The smooth, edge seam in a shirt collar as defined in claim 23, wherein:

said adhesive is composed of a thermoplastic material selected from the group consisting of polyamide, polyester, olefinic, polyurethane, and ethylene vinylacetate copolymer materials.

25. The smooth, edge seam in a shirt collar as defined in claim 22, wherein:

said adhesive has a melting point ranging from approximately 60 to 160 degrees Celsius.

26. The smooth, edge seam in a shirt collar as defined in claim 22, wherein:

said first collar component comprises a top of a collar, and said second collar component comprises a bottom of a collar.

27. The smooth, edge seam in a shirt collar as defined in claim 22, wherein:

said edge seam is an edge seam of a dress shirt.

28. The smooth, edge seam in a shirt collar as defined in claim 22, wherein:

said smooth, edge seam is the seam for a collar of a dress shirt.

29. The smooth, edge seam in a shirt collar as defined in claim 22, wherein:

said bonding element is a thermal adhesive web composed entirely of a thermal adhesive.

30. The smooth, edge seam in a shirt collar as defined in claim 22, wherein:

said interlining has a quantity of thermal adhesive at least on the second surface of the interlining.

31. The smooth, edge seam in a shirt collar as defined in claim 30, wherein:

said interlining is a woven interlining fabricated from cotton.

32. The smooth, edge seam in a shirt collar as defined in claim 30, wherein:

said interlining is a woven interlining fabricated from polyester/cotton blend.

33. The smooth, edge seam in a shirt collar as defined in claim 30, wherein:

said interlining is a nonwoven interlining fabricated from a material selected from the group consisting of polyester, nylon, and viscose and blends thereof.

34. The smooth, edge seam in a shirt collar as defined in claim 30, wherein:

said interlining is bonded to the first collar component prior to the manufacture of the garment.

35. The smooth, edge seam in a shirt collar as defined in claim 30, wherein:

said interlining is bonded to the first collar component during step (g) of claim 22.

36. The smooth, edge seam in a shirt collar as defined in claim 22, wherein:

said bonding strip comprises an interlining having on first and second surfaces a quantity of thermal adhesive.

37. The smooth, edge seam in a shirt collar as defined in claim 36, wherein:

said interlining is a woven interlining fabricated from cotton.

38. The smooth, edge seam in a shirt collar as defined in claim 36, wherein:

said interlining is a woven interlining fabricated from a polyester/cotton blend.

39. The smooth, edge seam in a shirt collar as defined in claim 35, wherein:

said interlining is a nonwoven interlining fabricated from a material selected from the group consisting of polyester, nylon, and viscose and blends thereof.

* * * * *

Disclaimer

6,070,542 — John Wong, Montreal, Canada. PUCKER FREE COLLAR SEAM AND METHOD OF MANUFACTURE. Patent dated Jun. 06, 2000. Disclaimer filed Feb. 21, 2006 by the Assignee, Taltech, Limited.

The term of this patent, subsequent to 5,568,779, 5,590,615, 5,713,292, 5,775,394, 5,782,191, 5,950,554 and 6,079,343 has been disclaimed.

(*Official Gazette May 23, 2006*)